United States Patent [19]

Buck

[11] 4,101,068

[45] Jul. 18, 1978

[54] DIE CUT TRAY

[75] Inventor: Stanley Edward Buck, Montreal, Canada

[73] Assignee: Domtar Inc, Montreal, Canada

[21] Appl. No.: 856,011

[22] Filed: Nov. 30, 1977

[51] Int. Cl.[2] ..... B65D 5/26

[52] U.S. Cl. ..... 229/35

[58] Field of Search ..... 229/32, 35, 36

[56] References Cited

U.S. PATENT DOCUMENTS

| | | | |
|---|---|---|---|
| 926,208 | 6/1909 | Palmer | 229/36 |
| 1,295,824 | 2/1919 | Beers | 229/35 |
| 2,008,935 | 7/1935 | Stern et al. | 229/35 |
| 2,319,371 | 5/1943 | Stonecypher | 229/36 |
| 2,784,900 | 3/1957 | Bauer | 229/35 |
| 3,107,040 | 10/1963 | Ullger | 229/32 |
| 3,425,543 | 2/1969 | Harvey | 229/35 X |
| 3,708,103 | 1/1973 | Evans | 229/32 |

*Primary Examiner*—Davis T. Moorhead
*Attorney, Agent, or Firm*—C. A. Rowley

[57] ABSTRACT

A blank or tray formed therefrom and including a bottom wall and side walls with the end walls formed by an end panel having a slit therein and by end flaps connected to the side walls and provided with upper and lower tabs. The structure of each flap is such that it may be folded along a diagonal fold-line to permit the upper tab to be moved into a position to be slid through the slot in the adjacent end panel and then the flap forced into a straightened position with the bottom tab received in a hole in the bottom wall. If desired, a lid assembly may be provided, the lid assembly having tabs thereon adapted to be received within extensions of the slit through which the top tab is received.

7 Claims, 4 Drawing Figures

DIE CUT TRAY

FIELD OF THE INVENTION

Present invention relates to a die cut tray, more particularly the present invention relates to a die cut tray that may be erected without requiring the use of separate securing means and may be flattened after use and reassembled when required.

BACKGROUND OF THE INVENTION

It is known to manufacture trays that are erectable without the use of extraneous securing means and that may be subsequently flattened and re-erected as required. A typical example-of such a carton is shown in Canadian Pat. No. 820,138 issued Aug. 12, 1969 to Paige Company. Generally such cartons require the use of extra materials to form the locking members and are therefore more expensive.

BRIEF DESCRIPTION OF THE INVENTION

The object of the present invention is to provide an inexpensive die cut tray that may be erected without requiring stitching or other extraneous fastening means and may be made using a minimum amount of material.

Broadly the present invention comprises a blank or tray formed therefrom and comprising a bottom wall, end walls foldably connected one to each end of said bottom wall by a fold line, at least one slit in each of said end walls, at least one slot in said bottom wall adjacent to each of said fold lines, a pair of side walls, one foldably connected each side of said bottom wall by a fold line substantially perpendicular to said fold lines connecting said end walls to said bottom wall, end flaps foldably connected one to each end of each of said side walls by a fold line substantially perpendicular to the fold line connection between said side wall and said bottom wall, each of said end flaps terminating in a free end and being provided with an upper tab projecting up from said flap and a bottom tab projecting down from the lower edge of said flap and a diagonal fold line extending across each said flaps from said free edge towards the junction of the fold line connection between said flap and said side wall to which it is attached and said fold line connection of said side wall to which it is attached and said bottom wall, said at least one slit in each said end wall and said diagonal fold line being arranged so that said end flaps may be folded said diagonal fold lines to lower the top edge of the said upper tab and permit said upper tab to be slid through said slot and said lower tab being positioned to cooperate with said slot in said bottom wall adjacent said fold lines connecting the adjacent of said end wall to said bottom wall when said tray is erected.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
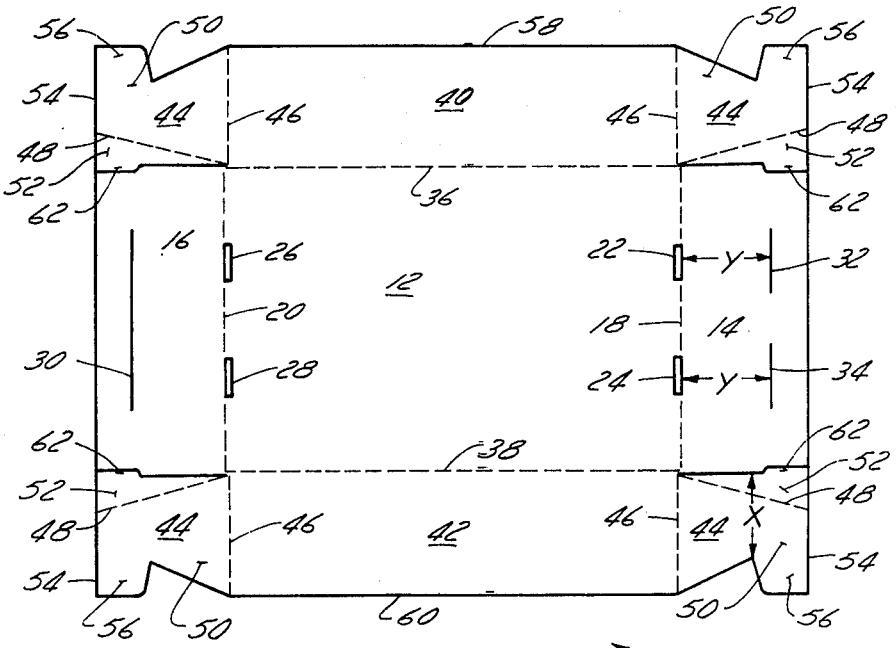
FIG. 1 is a plan view of a blank adapted to form the tray of the present invention.

Referring to FIG. 1, the blank 10 includes a bottom wall 12 having a pair of end wall 14 and 16 foldably connected thereto by a pair of parallel fold lines 18 and 20 respectively. Slots 22 and 24 formed in the bottom wall 12 adjacent to fold line 18 and slots 26 and 28 are similarily positioned relative to the fold line 20.

Each of the end walls 14 and 16 is provided with at least one slit 30. For illustration purposes the end wall 14 has been provided with two slits 32 and 34 and the end wall 16 only with a single slit 30, however, either variant may be used in each of the end walls, i.e. the end walls 14 and 16 may each have a single slit or they each have a pair of slits 32 and 34 or they may be as illustrated.

Foldably connected to the side edges of the bottom 12 by a pair of substantially parallel fold lines 36 and 38 are a pair of side walls 40 and 42 respectively.

An end flap 44 is connected one to the each ends of each of the side walls 40 and 42 by a fold-line 46. Each of the end flaps is divided by a diagonally extending fold-line 48 into an upper section 50 and a lower section 52. Each of the fold-lines 48 extends from the free edge 54 of the respective flap 44 (i.e. the edge of the flap 44 remote from the fold-line 46) to the junction of the fold-line 46 with the fold-line 36 or 38 respectively.

The top section 50 of each of the flaps 44 is provided with the tab 56 which in the illustrated arrangement is formed by cutting a portion of the upper section 50 from the flap. It will be noted that the top edge of each of the tabs 56 must not project above the top edge 58 or 60 of the side walls 40 and 42 respectively if as preferred a minimum amount of material is to be used. The bottom section 52 of each of the flaps 44 is provided with a bottom tab-62 that is cut out of the end panels 14 and 16.

The tabs 56 are adapted to co-operate with the slit 30, 32 or 34 respectively and the tabs 62 on each of the flaps 44 are adapted to co-operate with the adjacent hole 22, 24, 26 or 28 in the bottom wall 12 when the carton is erected.

In order to erect the carton, it is essential that the top edge of the tabs 56 be moved first into a position closer to the bottom wall 12 then the co-operating slit 30, 32, or 34. This is accomplished by positioning the fold-line 48 so that the bottom section 52 in each of the flaps 44 may be folded substantially perpendicular to the section 50 along fold-line 48 and permit the top edge of the tab 56 to be positioned immediately below the slits 30, 32 or 34. Thus the position of the inter-section of the fold-line 48 without free edge 54 and the angle of the fold-line 48 to the fold-line 36 and 38 must be co-ordinated with the position of the cooperating slot 30, 32 or 34 to insure that the tabs 56 can be positioned to be received within their co-operating slots.

It is important to the structural integrity of the erected tray that the distance between the bottom of each tab 56 and the bottom edge of its respective flap 44 (see distance X in the flap 44 at the bottom right-hand corner in the blank illustrated in FIG. 1) be substantially equal to the distance Y between the slit 30, 32 or 34 and the adjacent fold-line 20 or 18 respectively. Distance X may be slightly smaller than Y particularly in cases where the depth of the tray is relatively short, however, normally distance will be substantially equal to distance Y and the flap 44 will be bowed or deflected slightly to permit the bottom tab 62 to be moved into locking position in its respective slot 22, 24, 26 or 28, as will be described in more detail hereinbelow.

To erect the carton, the side walls 40 and 42 are folded into position substantially perpendicular to the bottom panel 12 and the flaps 44 are folded on the fold-line 46 into position substantially perpendicular to the panels or walls 40 and 42. The end walls 14 and 16 are also folded perpendicular to the bottom wall 12 along fold-lines 18 and 20. To lock the tray in an erected position the flaps probably one-at-a-time are folded along the fold-line 48 and the connected end wall 40 or 42 is twisted by further folding along fold-line 36 or 38 to move the bottom section 52 into face-to-face relation with the bottom 12 and position the tab 56 beneath the slots 30, 32 or 34. The side wall 40 is then moved back to a vertical position the tab 56 slid into its co-operating slot 30, 32 or 34. The bottom section 52 is forced into a position substantially in the same plane as the top section 50 of the flap 44 i.e. by straightening the fold-line 48 and thereby force the tab 62 into the adjacent hole 22, 24, 26 or 28 and hold the flap 44 in face to face relationship with the end wall 14 or 16. This procedure is repeated for each of the flaps 44 to complete the tray (see FIG. 2).

As above indicated, to force each of the tabs 62 into the adjacent hole 22, 24, 26 or 28 it may be necessary to bow the flap 44 inward away from the end wall 14 or 16 assuming that the distance X is substantially equal to the distance Y. If X is slightly shorter than Y no significant bowing of the flap may be necessary, however, this could only be permitted in relatively shallow tray or where the stability of the tray is not critical and bending of the side wall outward may be tolerated.

Figure 2:
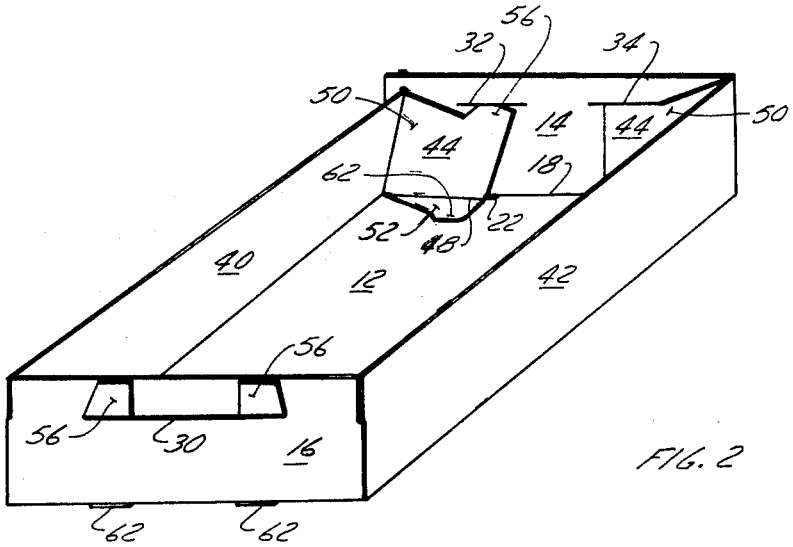
FIG. 2 is an isometric view of a tray substantially set-up from the blank of FIG. 1 but illustrating the manner in which the end flaps are locked in position to form the end walls.
Figure 3:
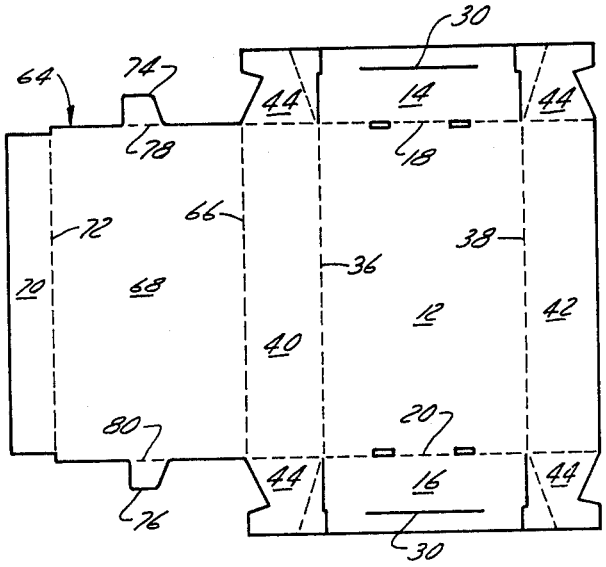
FIG. 3 is a view similar to FIG. 1 but illustraing the blank with an attached lid.

In the FIG. 3, 4 embodiment substantially the same blank is provided, however, the pair of slits 32 and 34 have been replaced by a single slit equivalent to slit 30 of FIG. 1 or 2 (therefore indicated by the number 30) and a top closure 64 has been connected to the top of the side wall 40 by a fold-line 66 substantially parallel to the fold-lines 36 and 38. The top closure 64 is composed of a top panel 68 with a tuck flap 70 connected thereto via a fold-line substantially parallel to the fold line 66. A pair of further tuck tabs 74 and 76 are connected to opposite sides of the panel 68 by a fold-line 78 and 80 respectively. These flaps 74 and 76 are positioned to co-operate with the slots 30 in the end-walls 14 and 16 respectively and the flap 70 is positioned in face to face relationship with the inside of wall 42 when the container is closed.

Figure 4:
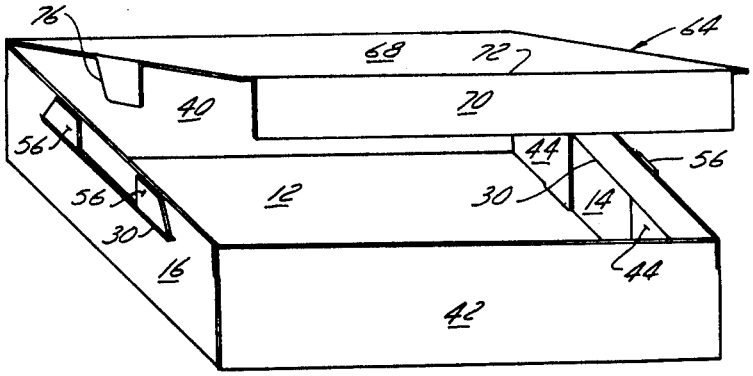
FIG. 4 is a view similar to FIG. 2 illustrating the blank of FIG. 3 erected.

The blank of FIG. 3 is erected in substantially the same manner as the blank of FIG. 1, however, to close the top 64 panel 68 is folded over along the fold-line 66 and the flaps 70, 74 and 76 are folded on the fold-line 72, 78 and 80 respectively in a position substantially perpendicular to the panel 68 (as shown in FIG. 4) the tuck flap 70 is then tucked on the inside of side wall 42 and the tabs 74 and 76 are slid into the slots formed by the slit 30.

Modifications will be evident to those skilled in the art without departing from the spirit of the invention as defined in the appended claims.

I claim:

1. A blank forming a tray, comprising a bottom wall, end walls foldably connected one to each end of said bottom by a fold-line, at least one slit in each of said end wall, at least one slot in said bottom wall adjacent to each of said fold-lines, a pair of side walls one foldably connected to each side of said bottom wall by a fold-line substantially perpendicular to said fold-lines connecting said end walls to said bottom wall, end flaps foldably connected one to each end of each of said side walls by a fold-line substantially perpendicular to the fold-line connection between said side wall and said bottom wall, each of said end flaps terminating in a free end and being provided with an upper tab formed in said flap and a bottom tap projecting down from said flap and a diagonal fold line extending across said flap from said free edge toward the junction of the fold-line connection between said flap and said side wall to which it is attached and said fold-line connecting said side wall to which is attached to said bottom wall, said, at least one slit in each said end wall and said diagonal fold-line in each said flap being arranged so that each said end flap may be folded along said diagonal fold-line to permit movement of each said end flap into a position wherein the top edge and upper flap may be received in the adjacent of said slits in said end wall, when said end flap is in face to face relationship with its adjacent end wall, said lower tab being positioned to co-operate with the adjacent said slot in said bottom wall when said tray is erected.

2. A blank as defined in claim 1 wherein said top edge of each of said top tabs is substantially aligned with the top edges of said side wall to which the flap which said top tab is formed is directly connected.

3. A blank a defined in claim 1 wherein the distance between each said slit and said fold-line connecting the end wall in which said slit is formed to said bottom wall is substantially equal to the distance between the bottom of said upper tab and said bottom wall when said blank is erected to form a tray.

4. A tray comprising a bottom wall, an end wall connected to each end of said bottom wall by a fold-line and extending substantially perpendicular to said bottom wall, a slit in each of said end wall at least one slot in said bottom wall adjacent to each of said fold-lines, a pair of side walls foldably connected one to each side of said bottom wall and extending substantially perpendicular to said bottom and end wall, end flaps foldably connected one to each end of each said side wall and extending substantially perpendicular to said side walls said end flaps being positioned between said end wall, each of said end flaps having an upper tab and a lower tab and a diagonal fold-line extending across the flap, said fold-line being in positioned to permit said flap to be moved to position the top edge of said upper tab to be received in the slit in the adjacent of said end walls, said top tab being slid through the adjacent end wall, said bottom tab being received within the adjacent of said slots in said bottom wall and said end flaps being in face-to-face relationship with the adjacent of said end walls.

5. A tray as defined in claim 4 wherein said end walls and side walls are substantially the same height and wherein said top tabs do not project above said end of side walls.

6. A tray as defined in claim 4 wherein the distance between each said slit and said bottom wall is substantially equal to the distance between the bottom of each of said upper tabs and said bottom wall.

7. A tray as defined in claim 6 further comprising a top foldably connected to the top edge of said side walls, said top comprising a top panel, a tuck flap foldably connected to said top panel at the side thereof remote from the connection of said top to said selected side wall and further tuck flaps one at each side of said top panel folded substantially perpendicular to said top panel in a position to be slid through the adjacent said slot in said adjacent end wall.

* * * * *